US006558490B2

(12) United States Patent
Klein et al.

(10) Patent No.: US 6,558,490 B2
(45) Date of Patent: May 6, 2003

(54) METHOD FOR APPLYING LABELS TO PRODUCTS

(75) Inventors: Timothy H. Klein, White Bear Lake, MN (US); Craig D. Bakken, Littleton, CO (US); Richard E. Schaupp, Modesto, CA (US)

(73) Assignee: Smyth Companies, Inc., St. Paul, MN (US)

( * ) Notice: Subject to any disclaimer, the term of this patent is extended or adjusted under 35 U.S.C. 154(b) by 0 days.

(21) Appl. No.: 10/017,339

(22) Filed: Dec. 13, 2001

(65) Prior Publication Data

US 2002/0084014 A1 Jul. 4, 2002

Related U.S. Application Data

(63) Continuation of application No. 09/318,875, filed on May 26, 1999, now abandoned, which is a continuation-in-part of application No. 08/944,310, filed on Oct. 6, 1997, now Pat. No. 5,925,214.

(51) Int. Cl.[7] ..... B65C 9/42; B65C 9/40; B65C 9/18

(52) U.S. Cl. ..... 156/64; 156/351; 156/361; 156/362; 156/541; 156/542; 156/DIG. 45

(58) Field of Search ..... 156/64, 350, 351, 156/361, 362, 363, 364, 542, 566, 556, DIG. 1, DIG. 4, DIG. 5, DIG. 33, DIG. 44, DIG. 45

(56) References Cited

U.S. PATENT DOCUMENTS

| | | | | |
|---|---|---|---|---|
| 4,294,644 A | | 10/1981 | Anderson | |
| 5,133,396 A | | 7/1992 | Selak et al. | |
| 5,256,239 A | * | 10/1993 | Voltmer et al. | 156/351 |
| 5,464,495 A | | 11/1995 | Edler | |
| 5,650,037 A | * | 7/1997 | Larson | 156/540 |
| 5,888,343 A | | 3/1999 | Olson | |
| 5,925,214 A | * | 7/1999 | Klein et al. | 156/361 |
| 6,328,832 B1 | * | 12/2001 | Otruba et al. | 156/64 |
| 6,428,639 B1 | * | 8/2002 | Oldenburg et al. | 156/64 |

FOREIGN PATENT DOCUMENTS

| | | | | |
|---|---|---|---|---|
| DE | EP0085418 | | 1/1983 | B65C/9/42 |
| EP | 339615 A1 | * | 11/1989 | B65C/9/42 |
| FR | EP0347290 | | 6/1989 | |

* cited by examiner

*Primary Examiner*—Richard Crispino
*Assistant Examiner*—Sue A. Purvis
(74) *Attorney, Agent, or Firm*—William W. Cochran

(57) ABSTRACT

A positionally based label application system includes a plurality of sensors which detect the pitch between the products to be labeled as well as the location of those products. A supply web bearing labels is caused to pass over a peel tip which feeds the labels into a nip point. This allows the labels to be precisely matched with products traveling at a very high rate of speed.

The positional system determines a desired ratio of movement between the supply web and the product being conveyed, this ratio being based upon the detected pitch. In this manner, the supply web is allowed to move continuously, but at a slower speed than the products being conveyed, but still precisely matches labels to products.

8 Claims, 8 Drawing Sheets

METHOD FOR APPLYING LABELS TO PRODUCTS

CROSS REFERENCE TO RELATED APPLICATIONS

This application is a continuation of U.S. non-provisional application Ser. No. 09/318.875 entitled "DEVICE AND METHOD FOR APPLYING LABELS TO PRODUCTS" filed May 26, 1999 now abandoned by Timothy H. Klein, Craig D. Bakken, and Richard E, Schaupp, which is a continuation-in-part of Ser. No. 08/944,310 filed Oct. 6, 1997, now U.S. Pat. No. 5,925,214 entitled "DEVICE AND METHOD FOR APPLYING PRESSURE SENSITIVE ARTICLES TO CARTONS" issued Jul. 20, 1999 by Timothy H. Klein and Craig T. Bakken, the entire disclosure of each is additionally specifically incorporated herein by reference for all that they disclose and teach.

BACKGROUND OF THE INVENTION

1. Field of the Invention

The present invention relates to a high speed method and device for applying labels.

2. Description of the Related Art

An application of relatively small labels to relatively large, flexible bodies, such as cartons and newspapers, has been an expensive, time-consuming and an inaccurate activity. The flexible bodies, such as cartons and newspapers, have been difficult to adhere adhesive articles and align with a labeling device. Furthermore, it has heretofore not been possible to adapt a device for labeling bottles to a device for labeling cartons and newspapers because the cartons and newspapers often travel at a very different rate than other types of products. Typically, the higher rates are much faster than can be accommodated by a conventional labeling device. The result is improper registration between the carton and the label. The poor registration becomes catastrophic within a very short period of time in a rapid labeling operation. A consequence is the significant loss of production time and maintenance that is required to correct and, repair damaged equipment in the label process. Excessive raw label material must be destroyed. Mislabeled products may also have to be destroyed.

Furthermore, it has always been difficult to increase the rate at which labels are applied to any type of article, while maintaining a sufficient level of consistency and avoiding damaging the articles, the labels, or the supply web.

The Eder patent, U.S. Pat. No. 5,464,495, issuing Nov. 7, 1995, describes a method and an apparatus for applying labels to containers and the resulting containers. With this method, containers are transported on rotatable support plates which are arranged in a circle on a rotating turntable. A leading edge of a label is adhered to a container as the container orbits past a vacuum-type label transfer drum. A curved guide which is tangential to the cylindrical body of the container, as the orbiting and rotating container passes, causes the label to wrap completely around the container. One of a circular array of heat-sealing elements which are rotated with the turntable adjacent each support plate is cammed radially outwardly of the turntable into contact with the region on the container where the trailing end overlaps the leading end of the label. This action fuses the ends of the labels together. The cam profile is adjustable in length to keep the time during which the heat-sealing member is in contact with the label ends overlap constant and independent of the rotational speed of the turntable.

SUMMARY OF THE INVENTION

A device for the precise delivery of labels includes a mechanism for web manipulation, a mechanism for label positioning, and a mechanism for micro-adjustment of the device for the precise delivery of labels. The label positioning device interacts with an article, such as a carton 15 or newspaper, in order to transfer labels from a web to the article.

The present invention also includes a method for applying labels to articles so that the labels have a consistent and precise alignment. The method includes providing a device with a web manipulation mechanism, a label positioning mechanism and a position mechanism micro-adjuster. A peel tip component of the device is spatially adjusted in a precise manner in order to produce precise alignment between the labels and the articles to which they are applied, at a variety of manufacturing speeds.

The present invention also provides a positionally based system for matching the placement of a label with the arrival of an article at a nip point, wherein the label is applied to the article at the nip point. In the most preferred form, the web carrying the labels is moved continuously and this movement is accurately adjusted for each article that passes through the nip point. To accomplish this a pitch sensor is provided that detects the pitch between the articles as they are moved along a conveyor. Subsequently, the articles location is detected by a registration sensor. This detection occurs at the approximate time that the preceding object receives a label. In addition, a label sensor is located near the supply web (prior to the nip point) to determine the pitch of the labels. The same sensor is also used to determine the position of a leading edge of each label.

A system controller receives all of the data and controls the distribution of the labels, by controlling the motion of the supply web. When the pitch of the objects is measured by the pitch sensor, this data is transferred to the system controller and an "electronic gear ratio" is defined for that article. That is, in order for a label located at a distance from the nip point, and an article that is similarly located some distance from the nip point to arrive at the nip point at the same time, some ratio of movement between the article and the label must be defined. For example, if the article is exactly twice as far from the nip point as the label, the article will have to move two incremental units for every incremental unit that the label moves. As such, the system is entirely positionally oriented and therefore fully functional, independent of velocity. Once this ratio is determined, a closed loop servo driving the supply web corrects the position of the web to achieve the desired ratio (since movement of the article conveyor is relatively constant).

When the article is detected by the registration sensor, the ratio that had been determined for the particular article is then implemented. Theoretically, the label and the object should then arrive at the nip point at the same time. This assumes perfect movement of the supply web and perfect spacing between the labels. Since neither occurs with sufficient reliability, a final adjustment is made. That is, when the article is detected by the registration sensor, the label sensor looks for the leading edge of the label to be placed. Since there is a difference in the distance between the registration sensor to the nip point and the distance between label sensor and the nip point, the label will be sensed at some point after the article is detected. This interval is predefined and any deviation noted (i.e., the label being detected earlier or later by the sensor) is recorded as an error. The system controller then causes the servo motor driving the supply web to temporarily accelerate or decelerate (with respect to the rate of motion of the product conveyor) to account for this error. Once the error is corrected, the supply web resumes moving at the predetermined ratio. This secondary adjustment occurs very rapidly and is generally very small. However, this adjustment is separate and distinct from the initial setting of the electronic gear ratio.

In operation, the supply web supporting the labels will move continuously. Adjustments will be made to the motion of the supply web; however, it will normally not stop moving unless an article is missing from the conveyor. The label and the article will arrive at the nip point at the same time. The supply web is pulled around the peel tip, thus causing the label to separate from the web. The continued motion of the web causes the label to move forward toward the nip point. The peel tip is positionally adjusted so that as the label enters the nip point, only a very small portion of the label remains adhered to the supply web. Entry into the nip point and partial attachment to the article causes the label to be pulled from the supply web as the article travels much faster than the supply web. Since only a very small portion of the label was in contact with the supply web, this pulling action has no negative impact on the supply web itself. Subsequently, a roller (forming the nip point) applies the remainder of the label to the object. Alternatively, the label could be launched or shot into the nip point. That is, no portion of the label will remain adhered to the supply web when the label enters the nip point. Such an arrangement requires very precise alignment, a high tolerance in the manufacture of the labels, and accurate control of the supply web.

The continuous motion of the supply web allows labels to be placed on articles at a far higher rate than other types of label applicators. Previous label applicators limited the speed at which the articles could be conveyed. That is, it has always been possible to increase the speed of the article conveyor, there just has not been a practical way to consistently apply labels at these increased speeds. The simplest traditional approach is to have the labels (supply web) travel at the same speed as the products (known as the wipe-on method). This has proven to be undesirable at higher speeds because the supply web cannot be economically manufactured to withstand the forces imparted at such high speeds. Because of the electronic gearing of the present invention, the supply web can move continuously at a lower rate yet still effectively match a higher rate article conveyor. As such, errors or defects on the labels or on the supply web are less problematic. For example, if a minor tear occurs in a supply web, the previous applicators would likely cause that tear to enlarge and likely sever the supply web due to the high forces involved (wipe-on method), the sheer forces generated during the frequent starting and stopping, and/or the tugging occurring with previous peel tip applicators. In the present system, such defects can be ignored because the supply web is moving constantly and consistently. Ultimately, this will reduce the number of failures caused by misalignment or catastrophic system shutdowns, thereby increasing efficiency and reducing cost. The present invention is also advantageously positionally based; that is, it will function properly regardless of the speeds being utilized.

In another embodiment of the present invention, a single registration sensor is utilized to detect the position of an article to be labeled. In operation, the supply web is advanced so that a large percentage of a label is separated from the supply web. As such, the label extends from the supply web (at or very near the peel tip) towards the nip point. The rigidity of the label is relied on to maintain this orientation. The position of the peel tip is very accurately adjusted so as to accommodate the length of the label in this manner. Just as the article approaches the nip point, the supply web advances, causing the label to enter the nip point. As explained above, once a portion of the label is adhered to the faster moving object, the label is pulled off the supply web. Since the contact (adhesion) between the label and the supply web is minimal, this pulling of the label has no negative effect on the supply web. Once done, the supply web again advances and stops, leaving the next label poised to be applied. The accurate deployment of the label to the nip point allows for labels to be applied to objects traveling at a high rate of speed without requiring the intermittent speed of the supply web to match or even approach the speed of the objects being conveyed. The registration sensor is used to detect the presence of the article as it approaches the nip point, and hence trigger the forward movement of the supply web.

In yet another embodiment, a single sensor is used to determine the pitch of the products as well as serving as the product registration sensor. The single sensor is placed upstream from the nip point and relies on the predetermined distance between the sensor and the nip point to effectuate the electronic gear ratio. This embodiment functions similar to the first except that the electronic gear ratio will be implemented a certain number of encoder pulse counts after the product passes the single sensor, rather than utilizing a second or registration sensor. This system benefits from the continuous motion of the supply web, however, it has fewer components involved. Its accuracy is dependent upon the tolerances of the encoders used and the methods employed to record and monitor pulse counts. That is, if the detection of encoder pulse counts used to engage an electronic gear ratio is embedded in a software subroutine, the practical limits of computing/microprocessors could reduce the accuracy at very high production speeds. However, a separate controller/detector could be utilized to monitor encoder pulses with respect to the single sensor, thus reducing or eliminating this problem. Obviously, microprocessors are available to perform this task at the speeds required, however, price considerations are also a factor.

As mentioned above (and equally applicable to all embodiments using a peel tip), the label will essentially have to span the gap between the peel tip and the nip point. Often, the labels used will have sufficient rigidity to accomplish this. However, some types of labels may simply be too flexible. As such, a further aspect of the present invention is the use of various label supporters. Rods may be placed from the peel tip to the nip point (above the label), to guide the label and to prevent it from moving upward. In addition, an air jet can be positioned to direct a stream of air towards the underside of the label, thus causing it to closely follow the rods. Similarly, a plate extending from the peel tip to the nip point can be utilized with or without the air jet. Alternatively, the plate could incorporate a vacuum which pulls the label towards the plate, allowing the plate to effectively guide the label to the nip point. Either the plate or the rods can be configured to extend just to the nip point, or, if the nip point utilizes a roller, slots can be cut into that roller. This allows the rods or the plate to extend past the outer circumference of the roller (which effectively applies the label to the object), thus leaving no gap at all for the label to span unsupported.

DETAILED DESCRIPTION OF THE PREFERRED EMBODIMENTS

Figure 1:
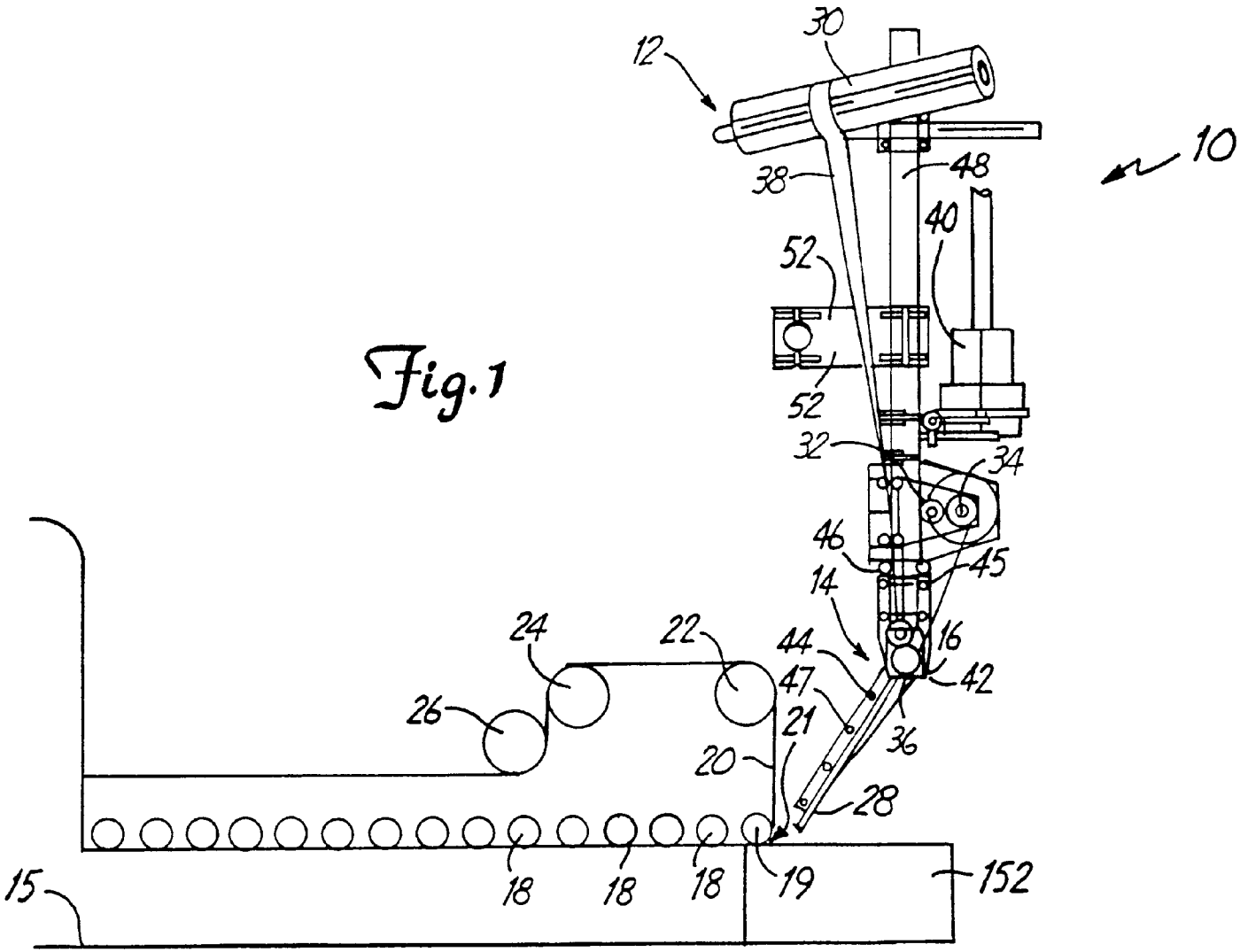
FIG. 1 illustrates a side view of an embodiment of the device of the present invention shown in a side plan view.

The device of the present invention illustrated generally at 10 in FIG. 1 includes a web manipulation mechanism 12, a label positioning mechanism 14 having a peel tip 28, and a position mechanism micro-adjuster 16. The label positioning device 10 of the present invention interacts with an article that is conveyed in some fashion. For example, objects such as article 152 may be conveyed on a belt 15 so that the top of article 152 is contacted and further driven by rollers 18 which are in turn, driven by a drive belt 20 that utilizes guide rolls 22, 24 and 26. The drive belt 20 only contacts the rollers 18 at or near their edge. Thus, the upper portion of article 152 contacts and is contained by the unobstructed portion of the rollers 18. The article conveyor is capable of running over a wide range of speeds. Alternatively powered rollers, a standard conveyor belt (with no upper rollers/support), or any other suitable means of conveying articles could be utilized, as would be appreciated by those of ordinary skill in the art. For illustrative purposes only, rollers 18 are only shown to the left of the label positioning device 10, but would generally extend further to allow the entire article 152 to pass beneath the peel tip 28. It is to be understood that with any use of the label positioning device 10, articles are conveyed past the peel tip 28. Generally, this involves placing articles on a conveyor, and mounting the label positioning device 10 above the articles. Alternatively, the label positioning device 10 could be orientated to place labels on articles from the sides or even from the bottom (so long as a sufficient portion of that surface is exposed to the peel tip 28). In addition, label positioning device 10 can effectively apply labels to a traveling web, such as another series of labels or printed matter.

The label positioning device 10 is spatially adjustable in a very precise manner in order to maintain a constant feed between a label supply, such as a continuous feed roll or a fan-fold label container. More specifically, the label positioning device 10 interacts with an article 152 at a nip point 21 which (in FIG. 1) is the point at which the article 152 first passes underneath drive belt 20 and first roller 19 (assuming movement of the article from right to left in FIG. 1). The consistent, precise alignment occurs because the label positioning mechanism 14, generally, and a peel tip component 28, in particular, are precisely positioned. As a result of this alignment, the label or coupon is consistently released and positioned upon an article.

Referring to FIGS. 4A–4E, the nip point 21 will be explained in greater detail. The creation and utilization of a nip point 21 allows for labels 150 to be aligned with, and placed on, articles 152 that are traveling at a greater speed than the label 150 is traveling at. Peel tip 28 is a precisely adjustable elongate member. As shown in FIGS. 4A–4E peel tip 28 will be adjustable, with a great degree of precision, to form a gap between the end of the peel tip 28 and the roller 154. This gap will be defined to be just shorter than the length of the label 150 being utilized. More specifically, the distance from the edge of the peel tip 28 to the nip point 28 (denoted X in FIG. 4E) is adjusted so that a label 150 having a leading edge in the nip point 21 will have only minimal contact with the supply web 38 at or near the peel tip 28. In practice, between ⅛"–1/16" of the trailing edge of label 150 will remain adhered to the supply web 38 when the leading edge engages the nip point 21. The nip point 21 is defined as the point at which the roller 152 is able to pinch any portion of label 150 against article 152, thus pulling label 150.

Supply web 38 is a flexible elongate member that bears a plurality of uniformly spaced, releasably adhered labels 150. As shown if FIGS. 4A–4D, supply web 38 moves initially from left to right, and wraps about peel tip 28. As such, supply web 38 then travels from right to left. When supply web 38 changes direction (at peel tip 28), the label 150 is "peeled" away. The continued motion of the supply web 38 causes the label 150 to be thrust forward toward nip point 21.

Figure 4A:
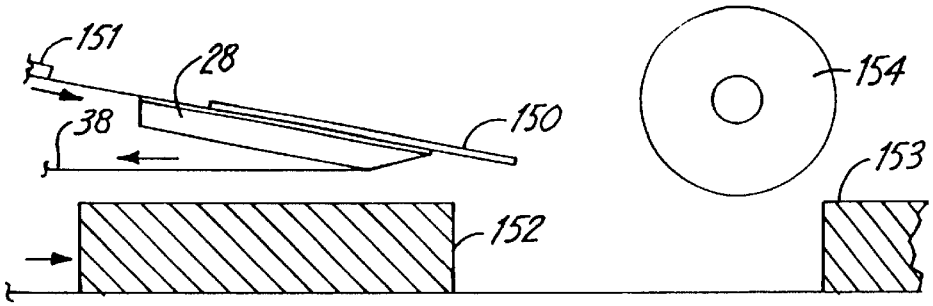
FIGS. 4A–4D show a label being fed into a nip point formed between a product and a roller.

In FIG. 4A, a first article 153 has just been labeled and is shown to the right of roller 10 154. The articles are traveling from left to right, and the articles will generally be traveling at a higher speed than the supply web 38 is moving. Supply web 38 has a plurality of labels 150, 151 uniformly spaced along its length. Label 150 is set to be applied to article 152. Supply web 38 is moving and changing directions of travel about peel tip 28. As this occurs, label 150 is separating from supply web 38, due to the rigidity of the label, the purposeful weakness of is adhesion between supply web 38 and label 150, and the forward momentum of the label 150.

Figure 4B:
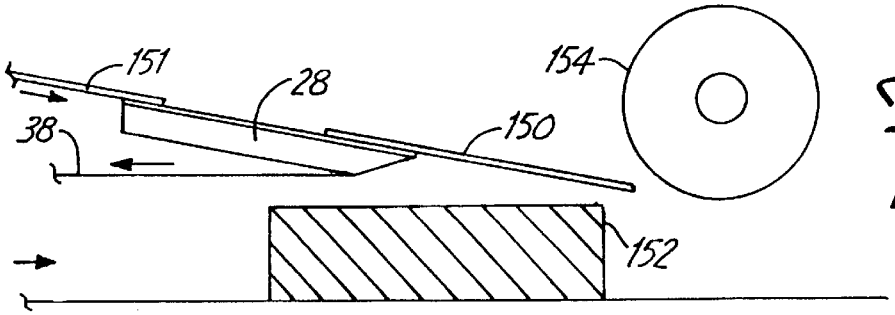
Figure 4C:
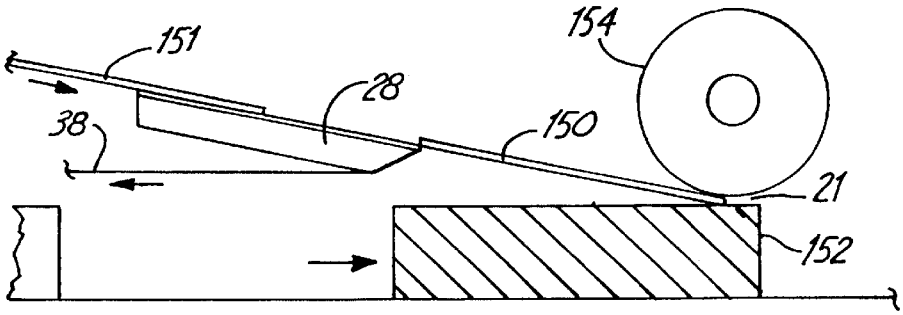

In FIG. 4B, both article 152 and label 150 have moved closer to the roller 154. In FIG. 4C, article 152 has arrived underneath roller 154. Roller 154 is rotating at the same speed article 150 is traveling. More precisely, the outer circumference of roller 154 travels at the same rate of motion as the article 152. To accomplish this, roller 154 is driven and the speeds are matched. It is possible to simply allow the article 152 to rotate the roller 154 via frictional engagement as a matching speed will obviously occur. Such an approach would work well if the articles were a continuous product or web (as is often the case). However, with discreet articles 152, problems could ensue when the first article through the system engages roller 154, when roller 154 is not yet rotating. As such, it simply avoids the potential for such problems to drive the roller 154. FIG. 4C label 150 has just entered nip point 21. As is shown, only a very small portion of label 150 remains affixed to supply web 38. At this point, label 150 is "pinched" between the roller 154 and the article 152 (thus causing label 150 to begin to adhere to article 152). The remainder of label 150 is then pulled off supply web 38. This occurs because the article 152 is traveling faster than the supply web 38, thus rapidly accelerating the label 150. Because only a small portion of the label 150 was adhered to the supply web 38, this sudden pulling does not cause any complications. If, however, a larger portion of the label 150 were adhered to the supply web 38, when the sudden acceleration of the label 150 occurred, the supply web 38 would be pulled out faster than the take up spool (or other waste handler) could handle, thus causing a slacking in the supply web 38 which would likely jam the system or alternatively, tearing the supply web 38. As such, it is the precise alignment of the peel tip 28 with nip point 21 that allows labels 150 to be applied to articles traveling at different and greater speeds. Previously, all such peel tip applicators were limited to the "wipe on" method. That is, the labels and supply web had to travel at the exact same speed as the articles to which they would be applied. As explained above, this seriously limited the capacity of the applicator.

Figure 4D:
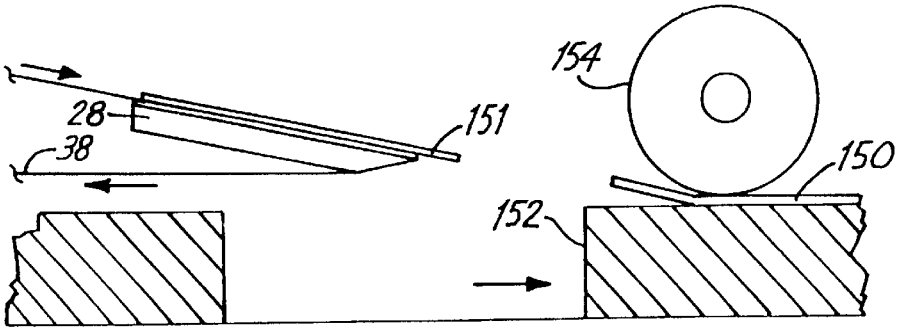
Figure 4E:
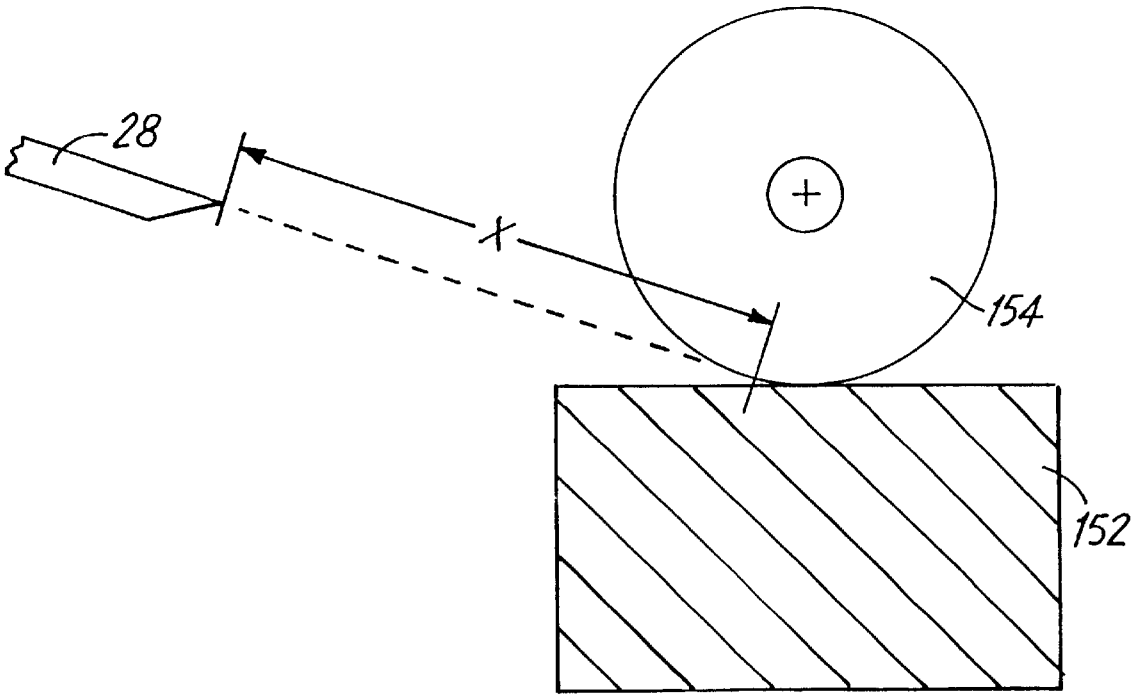
FIG. 4E shows the spatial relationship between a peel tip and a roller.

In FIG. 4D the label 150 has been entirely separated from the supply web 38 and is traveling at the same speed as article 152 and roller 154. As article 152 continues to move forward (to the right), the entire label 150 will be smoothed by roller 154 and applied to article 152. The next label 151 will subsequently be applied to the next article traveling down the conveyor.

It should be noted that different configurations of roller 154 are contemplated. In FIG. 1, roller 19 functions both as a containment and transport roller (18) for article 152, and also as the smoothing roller 154 which forms nip point 21. For most applications, roller 154 will not be part of the conveyance system. Rather, roller 154 will be adjustably mounted to a frame surrounding peel tip 28, or will be a freestanding unit, from which peel tip 28 is referenced. Though roller 154 is shown and described, any nip point mechanism could be utilized equally well. For example, a belt, brush, bearing arrangement or similar device could be configured to form nip point 21, rather than using roller 154. The nip point mechanism could be any such device so long as nip point 21 is formed so that labels 150 entering nip point 21 are properly applied to the various articles.

As described above, label 150 enters nip point 21 just as the trailing edge of the label 150 is minimally adhered to the supply web 38. The labels 150 could instead be "shot" or "launched" into the nip point 21. That is, as the leading edge of label 150 enters nip point 21, the trailing edge of label 150 is entirely free of supply web 38. This requires very precise alignment of the peel tip 28 and very precise control of the supply web 38 (and hence the labels 150). Both are readily accomplished with the present invention. A stream feeder could be used instead of peel tip 28, if labels 150 are to be freely launched into nip point 21.

The device of the present invention 10 utilizes a very different way of viewing the process of label application from what has heretofore been used. Typically, the problem that must be solved in label application devices relates to matching the speed of a label to the speed of an article. Cumbersome articles, such as newspapers or cartons have not been easily labeled at any speed. Successful labeling had typically required low speed operation. The device of the present invention does not rely upon speed matching. Rather, the device of the present invention utilizes precise positional calibration of delivery components (such as a peel tip 28 ) in order to match a label to the surface of an article, such as a carton or newspaper.

Furthermore, the device 10 may be used to transfer a wide variety of labels to a wide variety of items such as cartons. Any article that can be aligned with peel tip 28 could then be labeled. The types of labels transferable include single component labels in sizes ranging from large to small. Coupon labels, packets, or fan folded label may also be transferred with the device of the present invention. As used herein, labels or coupons refer to any type of article that is subsequently attached to a substrate article. Labels preferably have a pressure sensitive adhesive for binding with the substrate article.

Referring back to FIG. 1, the label positioning mechanism 14 includes the peel tip 28. The peel tip 28 may be adjusted by changing the angle with which the peel tip 28 contacts a horizontal surface and by changing the orientation of the peel tip 28 so as to vary the distance between the terminus of the peel tip 28 and the nip point 21. The change in orientation can be accomplished by changing the position of the peel tip 28 and by changing the radial orientation of the peel tip 28. The peel tip 28 may be shaped to accommodate a variety of coupons or labels. The tip may be quite sharp or may be blunt, as required.

The position adjusting mechanism 16 includes knobs 42, 44 and 46. The peel tip 28 position is adjustable by rotation of knobs at 42, 44, and 46. The knob at 42 adjusts the angular position of the peel tip 28 with respect to the horizontal by raising the peel tip 28 or lowering the peel tip 28. The knob 42 is positioned at a hinge where the peel tip 28 is attached to a support frame 45 that is secured to a rail 48.

The knob at 44 adjusts the spatial orientation of the peel tip 28 with respect to articles passing beneath it. In particular, the peel tip 28 may be moved in a linear direction along the rail 48. The peel tip 28 may be moved closer to the carton or newspaper or farther away.

The knob at 46 adjusts the length of the peel tip 28. In particular, the peel tip 28 may be moved within an extender 47 and tightened with the knob 44 to increase or decrease the length as required. The extender 47 defines a series of holes. Screws or other fastening devices may be placed in the holes in order to retain the peel tip 28. The peel tip may be moved incrementally along the extender 47 in order to lengthen or shorten the peel tip 28 as required.

The knobs 42 and 46 permit micro-adjustment of the peel tip 28 because the rotation of each of the knobs imparts a comparatively small movement to the peel tip 28. Thus, an operator can make adjustments in a range of as low as one millimeter with comparatively large radial movements associated with turning one of the knobs of 42 or 46. For instance, in the case of radial movement, an operator may turn knob 42 a full turn in order to adjust movement of the peel tip 28 one degree.

The micro-adjustment of the device 10 of the present invention permits a wide range of motion and renders the device 10 highly adaptable to a variety of special orientation conditions. This adaptability in particular, enables the device 10 of the present invention in conjunction with conventional coupon labeling device to apply coupons to a web with articles that have typically been very difficult to label in a high speed process such as cartons or newspapers.

While specific peel tip 28 support mechanisms have been illustrated, it is to be understood that any structure may be utilized which securely supports the peel tip 28 and allows for a sufficient degree of spatial alignment. Furthermore, fixed systems are possible wherein the peel tip 28 is permanently secured in a fixed relationship to an article conveyor. This would be a dedicated system which would only be able to label the specific product it was set up for, with a predetermined label.

Figure 2A:
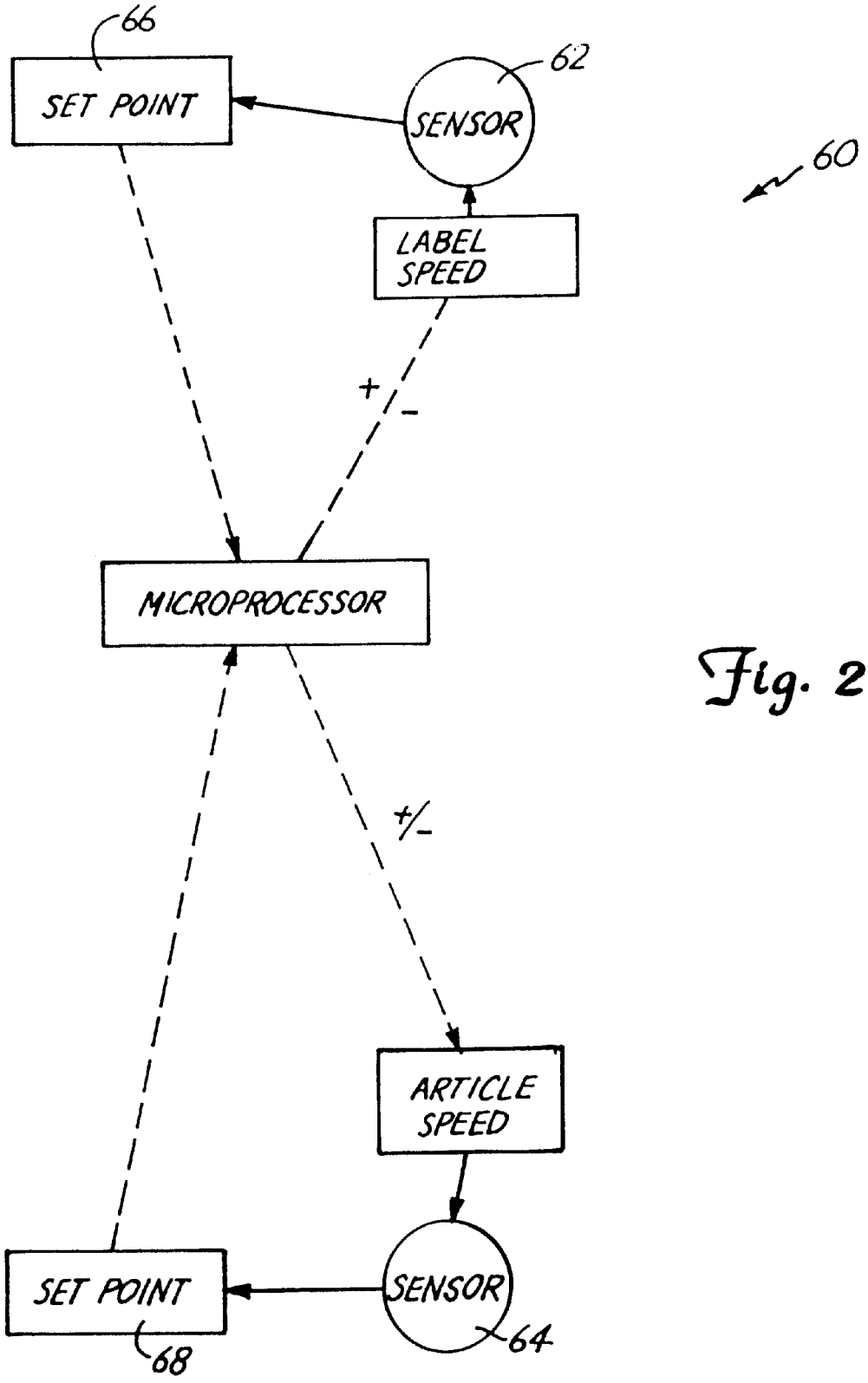
FIG. 2A is a schematic view of one embodiment of a servo-control mechanism for the device of the present invention.
Figure 2B:
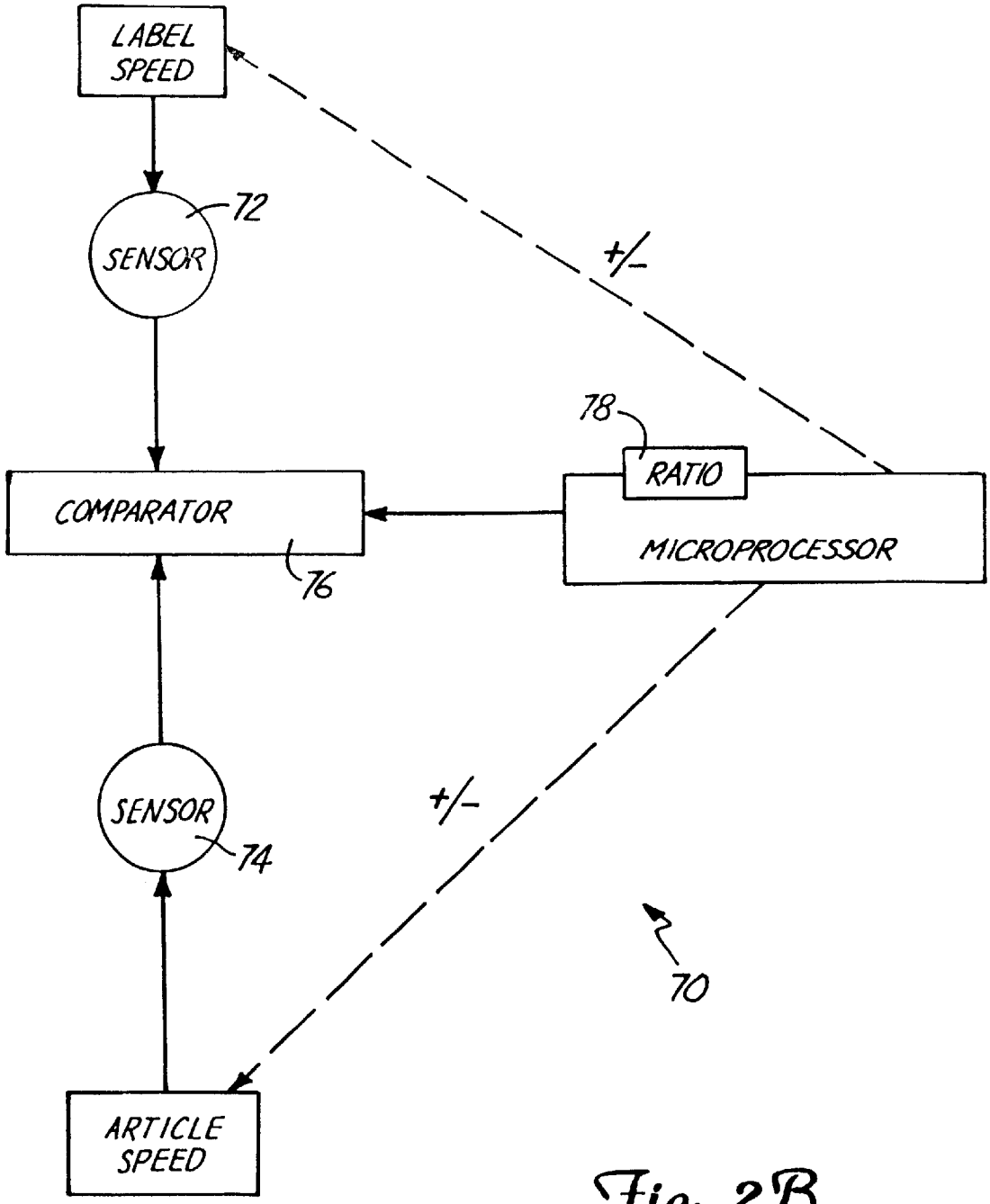
FIG. 2B is a second embodiment of a servo-control mechanism for the device of the present invention.

It is also contemplated that the speed of the device of the present invention may be trimmed in a servo-mechanism or closed loop electrical scheme such as is shown at 60 in FIG. 2A and 70 in FIG. 2B. With this type of control, a device of the present invention can be controlled so as to increase or decrease speed of web feed in accordance with speed increases or decreases in article feeds such as newspapers or cartons which must be labeled.

One schematic view of an embodiment of the servo-control mechanism shown at 60 in FIG. 2A includes sensors 62 and 64 for monitoring label speed and article speed, respectively, and a microprocessor programmed with set points for each of the label speed at 66 and article speed at 68. The set points are established in order to create a ratio of label dispensing speed to article speed.

Another embodiment of the servo-mechanism control, shown at 70 in FIG. 2B includes sensors at 72 and 74 for each of the label speed and article speed, respectively. Sensor data is transmitted to a comparator 76. The comparator is programmed with a desired ratio of label speed to article speed as is shown at 78. A controller then commands the device of the present invention to either speed up or slow down in order to match the ratio. The servo-mechanism permits the device of the present invention to remain on-line even when changes are made in the speed of article conveying.

Figure 5:
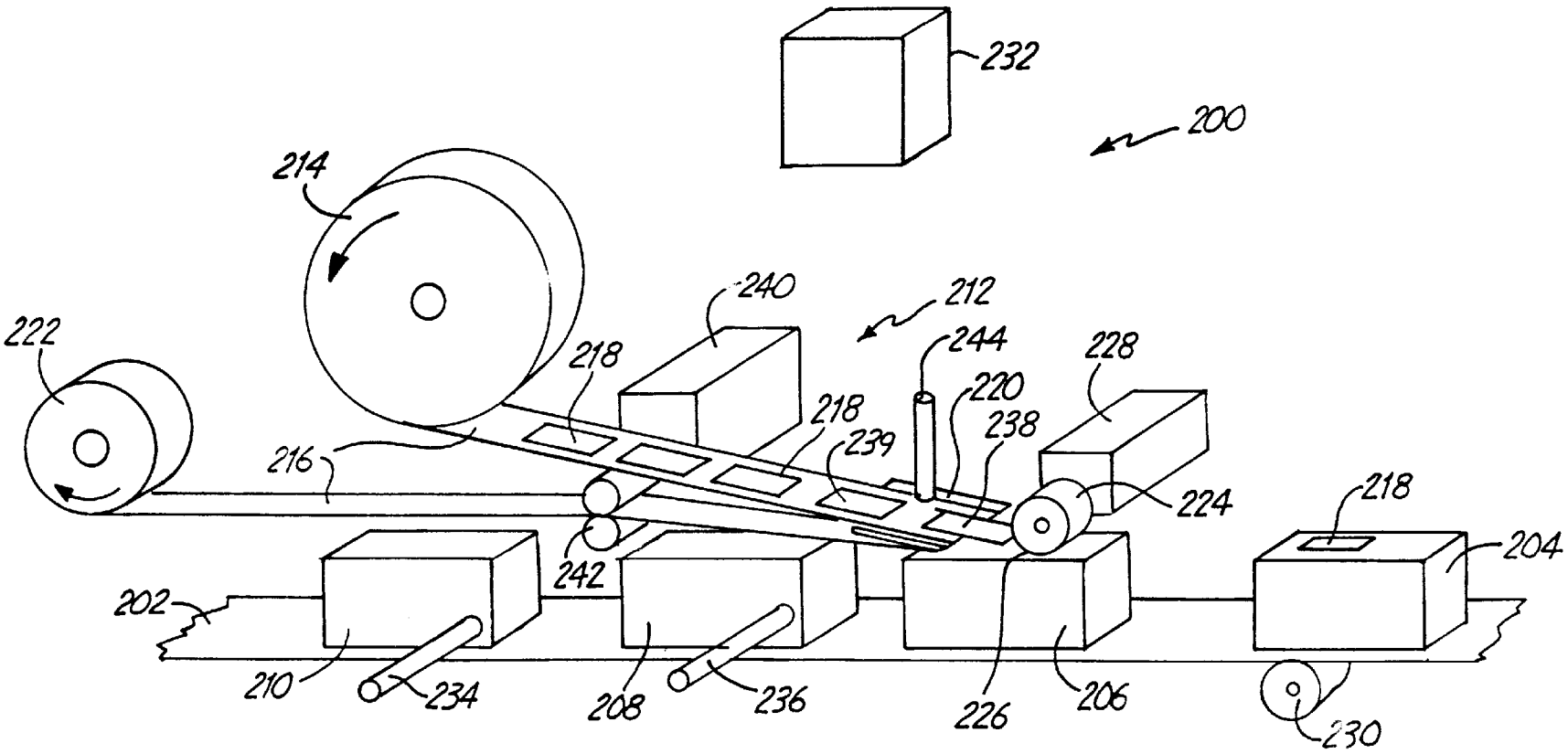
FIG. 5 is a schematic illustration of a positionally based label application system.

In its most preferred form, the control system of the present invention is positionally based, as opposed to the speed matching described above. FIG. 5 illustrates the operation of a positionally based label applicator system 200. A conveyor belt 202 is positioned to transport objects such as articles 204, 206, 208, and 210. It is intended, through the operation of the system 200, to label each object in a consistent manner. Conveyor belt 202 moves from left to right, at a high and generally continuous rate of speed. It is to be understood that during normal operation, a continuous stream of objects, such as articles 204, 206, 208, and 210, will be placed on conveyor 202. In practice, the spacing between objects, or pitch, will fluctuate somewhat.

A label applicator 212 is positioned generally above and parallel to the conveyor belt 202, with sufficient space provided to allow objects, such as articles 204, 206. 208, and 210 to pass. Label applicator 212 includes a supply roll 214 of labels 218 which are releasably adhered to supply web 216. Supply roll 214 is orientated so that as it is unrolled, labels 218 will be exposed on an upper surface of supply web 216.

Figure 3:
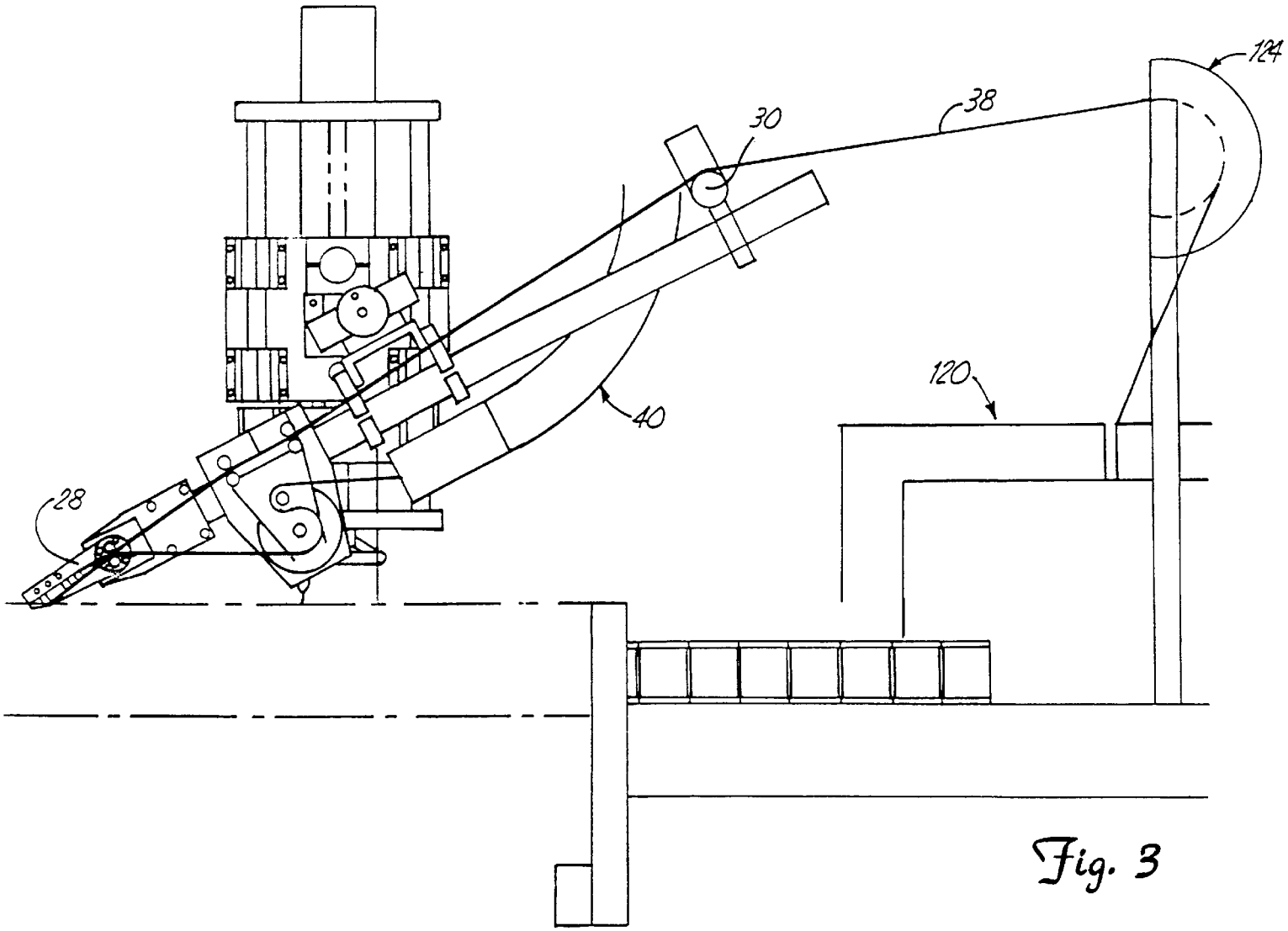
FIG. 3 illustrates a side view of a peel tip assembly coupled with a label supplier according to the present invention.

Supply web 216 is caused to pass over peel tip 220 to waste roll 222, where it is wound for disposal or reuse. Supply web 216 is driven by drive unit 240 which has a pair of rollers 242 that engage the supply web 216. Peel tip 220 is shown diagramatically in FIG. 5, however it is to be understood that it is precisely positionable as described above. For example, structure similar to that shown in FIGS. 1 or 3 may be employed here. As supply web 216 passes around peel tip 220, labels 218 are caused to separate from the supply web 216 and continue to move forward. Roller 224 functions as the nip point mechanism and is positioned adjacent to the peel tip 220 so as to form a nip point 226. Roller 224 is powered by a drive unit 228 which includes an encoder. A conveyor encoder 230 is positioned so as to be rotated by the movement of conveyor belt 202. In general, the encoders function by dividing a single rotation of a rotatable element into a large number of evenly spaced incremental units which are mechanically or electronically detectable. The encoders can then precisely measure movement of the object they are in contact with.

A system controller 232 is utilized to control the various attributes of the positionally based label applicator system 200. Though not shown, system controller 232 is coupled with each of the components as described. Drive unit 228 and its included encoder are coupled with system controller 232 to communicate information about the current rate of rotation of drive roller 224, and to adjust this rate where appropriate. Conveyor encoder assembly 230 provides data to the system controller 232 indicative of the distance traveled by the conveyor belt 202. The system controller then causes drive unit 228 to rotate roller 224 at the same rate. That is, for every incremental distance that conveyor belt 202 moves, the outer circumferential edge of roller moves the same incremental distance. This results in the roller 224 and the conveyor belt 202 traveling at the same rate.

Located upstream from the nip point 226 is a pitch sensor 234. Pitch sensor 234 is used to detect the pitch or distance between the various articles 204, 206, 208, and 210 as they are transported by the conveyor belt 202. As mentioned above, this pitch will vary between any given pair of articles. This variance in pitch occurs due to the placement of the article on a belt which is already moving at a high rate of speed causing shifting to inevitably occur. However, once the articles 204, 206, 208, and 210 are moving at the speed of belt 202, the pitch between any given pair of articles will remain constant, during normal operation. Pitch sensor 234 is set to detect the leading edge of each article 204, 206, 208, and 210. Therefore, the number of encoder units are counted from leading edge to leading edge, thus giving the pitch of the products. This information is passed to a FIFO type (first in, first out) shift register that is accessible by and may be included within, system controller 232. Any suitable detector which can detect the articles could be used as pitch sensor 234. One optimum configuration is to provide a light source and a receiver to act as a photointerrupter.

As shown in FIG. 5 pitch sensor 234 would have just detected the leading edge of is article 210. Prior to that, pitch sensor 234 would have detected the leading edge of article 208, which has subsequently moved downstream. During the interval between the detection of leading edges, the number of pulses generated by conveyor encoder 230 would be monitored; thus giving the pitch between article 208 and 210. This pitch value is input into the shift register. Prior to this occurring, the pitch between articles 208 and 206 had been determined in the same manner, and input into the shift register.

Located downstream from the pitch sensor 234 is a registration sensor 236. Registration sensor 236 also triggers off the leading edge of each article, however it is completely independent from pitch sensor 234. Registration sensor 236 is used to initiate an "electronic gearing" sequence between the subsequent movement of the detected article and the label 218 to be applied. Conceptually, this means that the supply web 216 (and hence labels 218) and the conveyor belt 202 must each move at a specified ratio with respect to one another. This ratio is applicable only for the particular article that has been detected by registration sensor 208. The goal is to have that article and the next available label 218 arrive at the nip point 226 at precisely the same time. This is done via a positional control system which causes the rate of movement of the supply web 216 to be adjusted to the proper ratio. For example, if the article is twice the distance from the nip point 226 as the label 218, the label 218 will only have to move one incremental unit for every two incremental units that the conveyor belt 202 (and hence the article) moves. These incremental units are indicated by encoders which have the same calibration. To accomplish this, a closed loop drive system is used. In this way, system controller 232 will cause drive unit 240 to achieve the desired ratio, regardless of the speeds involved. That is, system controller 232 monitors the encoder within driver unit 240 and the conveyor encoder 230 and causes the proper adjustments to be made until the proper ratio is achieved.

Referring to FIG. 5 article 204 has had a label 218 applied, and is moving downstream to be further utilized.

Article 206 is having label 238 applied to its upper surface. This occurs in the same fashion as described above; that is, the label 238 is fed into the nip point 226 at one speed, and the coaction of the roller 224 and article 206 causes the label 238 to be pulled away from the supply web 216.

The entire process will be described with reference to article 208, which is next in line to be labeled. At some point in time, earlier than that shown, the leading edge of article 206 was sensed by pitch sensor 234. Subsequently, the leading edge of article 208 was sensed by pitch sensor 234. During the interval between the two, controller 232 using encoder 230, recorded the distance traveled by conveyor belt 202 as a particular incremental count. For illustrative purposes only, assume that the count between the leading edges of article 206 and article 208 was "1000"; thus giving a pitch of "1000". That is, there are "1000" increments of conveyor encoder 230 between the leading edge of article 208 and the leading edge of article 206. As soon as the pitch is determined, it is input to the shift register. This effectively determines the electronic gear ratio needed for article 208. In other words, the system knows that 1000 units after the label is applied to article 206, the next label must be in position to be applied to article 208. Though not discussed in this example, various constants can be added so that the label 218 is offset from the edge (i.e., centered on the article).

The leading edge of article 208 subsequently triggers the registration sensor 236. It is this trigger that causes the system controller 232 to implement the previously determined electronic gear ratio. The distance between the registration sensor 236 and the nip point 226 is fixed and the spacing between labels 218 is uniform. A variation is encountered because of the difference in pitch between the articles. To accommodate this variation, the supply web 216 is caused to travel at different rates. Since it travels at different rates, and the various articles will arrive at the registration sensor 236 at different intervals, the electronic gear ratio for a particular article can only be implemented when that particular article passes the registration sensor 236. In other words, when article 208 trips registration sensor 236, the space from the label 239 to the nip point will depend on when the previous article 206 was labeled.

Specifically, for article 208, assume that when registration sensor 236 is tripped, label 239 has "500" units to travel until it reaches the nip point 226. Since the article 208 must travel 1000 units, the ratio is 1:2. That is, the supply web 216 will only have to move one unit for every two units that the conveyor/article moves to end up arriving at the nip point 226 at the same time. To achieve this, a closed loop servo system forms part of drive unit 240, which also includes a separate encoder (not shown) that is calibrated with conveyor encoder 230. Alternatively, an open looped driver or motor could be employed so long as the system is ultimately closed.

Since the electronic gear ratio utilized for article 206 will very likely be different than that used for article 208, the drive unit 240 will have to move the supply web faster or slower relative to the motion of conveyor 202. As mentioned above, the conveyor belt 202 travels at a constant rate so the adjustment to the rate of motion of the supply web 216 is all that is varied. As can be seen, this system will work regardless of the speed of the conveyor belt 202. Even if an error were to occur in driving the conveyor belt 202, causing an unexpected increase or decrease in its speed, the proper adjustment would be made to the movement of the supply web 216 because of the positional dependence of the system as determined by the various encoders.

The above described electronic gear ratio relies on the uniform spacing of labels 218 along supply web 216. The pitch of the labels must be input into the system prior to its initial use. To do so, label pitch sensor 244 measures the pitch of the labels 218 that are initially run through the system. That is, at the start of any given production run, several labels 218 are caused to pass under label pitch sensor 244 just to make this measurement, without the expectation that these labels will be applied accurately to any object. The pitch of the labels is determined by measuring the units of an encoder from the leading edge of one label to the leading edge of a subsequent label and subtracting out the label length. Once the pitch of the labels 218 has been determined, this value is used as a constant. The label pitch sensor is generally aligned with and moves with peel tip 220, though it may be placed anywhere adjacent to supply web 216. Multiple spools of labels 218 can be spliced together to form a continuous supply. The pitch of these labels 218 will generally be the same and the variation encountered at the splice can be dealt with by the below described secondary adjustment to the supply web 216. Alternatively, the system could be configured to periodically or continually monitor actual label pitch and make any necessary adjustments.

In theory, the above procedure should cause articles 204, 206, 208, and 210 to arrive at the nip point 226 with an appropriate label 218 arriving at the same time. However, in practice minor variations can prevent this from happening consistently. For example, the pitch of the labels 218 is assumed to be constant. This is often not the case, and any actual error encountered could be amplified during the course of the production run. Furthermore, the actuation of the drive unit 240 will inevitably have some time delay, however minor. Again, over the course of a long production run, such minor errors could eventually lead to unacceptable results. To prevent such errors from occurring a separate and distinct adjustment can be made, beyond assigning and setting the electronic gear ratio, utilizing label pitch sensor 244.

The leading edge of article 208 is about to trip registration sensor 236. Some time later, the leading edge of label 239 will trip label pitch sensor 244. This information is used to determine and/or verify the position of article 208 and the label 239, independent of their speed. Because of the offset of the registration sensor 236 and the label pitch sensor 244, with respect to the nip point 226, as well as the relative distances and rates of motion involved, the leading edge of the article 208 should trip the registration sensor 236 before the leading edge of the label 218 trips label pitch sensor 244. The order of detection is irrelevant and simply depends on the relative position of the two sensors with respect to one another. The label pitch sensor 244, with the arrangement illustrated, will be tripped after the electronic gear ratio has been implemented. As such, the difference (in encoder units) between the tripping of the two sensors should be constant. That is, every time an article trips registration sensor 236, the leading edge of a label 218 should be detected after a set number of encoder pulses. Any variation from this constant that is detected is deemed to be an error which is transmitted to the system controller 232. The system controller 232 causes the closed loop servo system in drive unit 240 to rapidly move the supply web 216 to correct the error detected. Because this is done for each label 218, and the errors involved are generally minor to begin with, this correction is relatively small and is often visually imperceivable by an observer.

For example, assume that the leading edge of label 239 should be detected by label pitch sensor 244 after "200"

encoder units have been detected. If the label 239 is detected at "210" encoder units, it means that label 239 is lagging behind where it should be. However, it is already traveling at a fixed ratio with conveyor belt 202. This ratio had been determined previously by the pitch sensor 234, in order to allow sufficient time to make the appropriate calculations and adjustments (which is obviously not instantaneous). As such, any correction done at this point must be very rapid. Here, label 239 is 10 encoder units back from where it should be. Using the example above, label 239 is already supposed to travel one encoder unit for every two encoder units that the article 208 travels. Therefore, once this additional error is detected, label 239 is rapidly driven so as to travel 11 encoder units while the article 208 travels 2 encoder units. Thereafter, the error has been corrected and the rate of motion of the supply Web 216 is again returned to the 1:2 ratio with the conveyor belt 202. The amount of the error will determined the interval over which it may or must be corrected. Namely, if a larger error is 25 detected, it may require a larger number of encoder intervals to make the correction, before returning to the assigned ratio.

As article 208 progresses, it will eventually reach nip point 226. While this may occur at any speed, it is usually desirable to have the articles traveling very rapidly. As described above, when article 208 reaches nip point 226, label 239 will reach the nip point 226 at the same time. However, the article 208 will be traveling at a much greater speed. Again, when label 239 enters the nip point 226 and begins to adhere to the article 208, only a very small portion of the label 239 will still be attached to the supply web 216. Therefore, as the label 239 is accelerated and pulled away from the supply web 216, no negative effects are imparted to the supply web 216. In this manner, supply web 216 is allowed to move continuously which in turn reduces the stresses imposed on it.

Because of the electronic gearing, the labels 218 are able to be matched to articles traveling at much higher speeds that a supply web 216 would be able to be run at. For example, it is expected that in one embodiment, the present system can label upwards of 80,000 units per hour, with the distance from one leading edge of a product to the next being about 19 inches. For example, in one test run, "12 Pack" soda cartons were successfully labeled at an average rate of 50,000 units per hour—the maximum rate the carton assembly line could run at. It should be noted that labeling at these rates is not without consequences. For example, with the above described test run, 5 miles of waste material (supply web) were generated every hour. This is a large volume of material that must be handled quickly and effectively. As such, venturi shredders or other known devices are optimally used to handle this high volume of waste product.

The above described system is meant to run continuously during normal operation. That 20 is, supply web 216 may be caused to increase or decrease its rate of motion, but not stop entirely. However, if pitch sensor 234 ever fails to detect a subsequent article, the supply web 216 must then be stopped. The system can be configured to require a manual reset if such an event occurs, or supply web 216 could simply be automatically restarted when and if a subsequent article is ever detected.

Again referring to FIG. 5, an alternative arrangement of the above embodiment will be described. In this embodiment, registration sensor 236 is eliminated. As such, pitch sensor 234 can be moved further upstream, if desired. Pitch sensor 234 is used to detect an edge of the various articles and hence arrive at the pitch of those articles. That pitch is then input into system controller 232 and, at the appropriate time, that pitch is used to set the electronic gear ratio for a particular product. Previously, registration sensor 236 was used to trigger the system to implement that electronic gear ratio. A registration sensor 236 was provided as a separate sensor because of the practical limits of current, cost effective microprocessors and software systems. The registration sensor 236 served to provide a timing or control signal that was outside of the hardware/software loop, hence increasing accuracy. If a single sensor is utilized, its position from the nip point 226 is determined. Then when the leading edge of an article is detected by sensor pitch 234, the system 200 will implement the appropriate electronic gear ratio some number of encoder pulse counts later. There must be a sufficient amount of time for the system 200 to calculate and implement this electronic gear ratio, prior to the article reaching the nip point 206. As such, there will be a minimum distance that the pitch sensor 234 can be placed from the nip point 226.

In use, the leading edge of an article 210 will be detected by pitch sensor 234. At some earlier time, the leading edge of article 208 would have likewise been detected, thus the pitch between article 208 and 210 is now known. After a predetermined number of encoder 230 pulses have been detected, the electronic gear ratio for this pitch is then implemented. The system will then function in the same manner as previously described. Eliminating the registration sensor 236 will somewhat reduce the accuracy of the system 200 because an additional computing step is now required within the 10–20 millisecond window allowed to perform all of the necessary computations. That is, the software implemented can only detect encoder pulses at a predetermined point within a program loop. This simply makes it more difficult to concurrently monitor encoder pulses, determine pitch, calculate and implement the electronic gear ratio, detect the pitch/position of the labels 218 and make final adjustments to the label 218 position at the high speeds the present system 200 operates at. However, depending on the end use, a minor variation in accuracy may be worth the savings in simplifying the equipment used.

Alternatively, the monitoring of encoder pulses for purposes of triggering the electronic gear ratio could be performed by a hardware/software monitor that is separate and distinct from system controller 232; however, this effectively then becomes registration sensor 236 (using encoder pulses rather than a photointerrupter). In other words, the system controller 232 will be tripped by an input from an encoder monitor rather than by an input from a photointerrupter. The advantage would then be one less sensor to physically align on a production line and the system would be accurate to +/−1 encoder pulse.

In another alternative embodiment, not separately shown, the supply web 216 is run intermittently rather than continuously. In this embodiment, there is no need to measure the pitch between each article 204, 206, 208, and 210. Instead, after each label 218 is applied, the next label is automatically thrust forward to a point short of the nip point 226. A registration sensor 236 senses the arrival of the article 204, 206, 208, and 210 at or near the nip point 226 causing the supply web 216 to again move forward, thrusting the label 218 into the nip point 226. In this configuration, the registration sensor 236 will be moved closer to the nip point 226. Furthermore, this embodiment could still use encoders to make positional determinations (i.e., thrust the label 218 a certain number of encoder units after registration), but will work equally well simply by triggering directly from the registration sensor 236.

Once the label 218 is thrust into the nip point 226, it is removed and applied to the article as previously described.

The supply web 216 continues to move forward until the next label is proximate the nip point 226, then stops until the next product trips the registration sensor 236. This method is accurate and also very rapid, however due to the intermittent movement of the supply web 216 the maximum rate of application will be less than that achievable with the continuous motion method.

Figure 6:
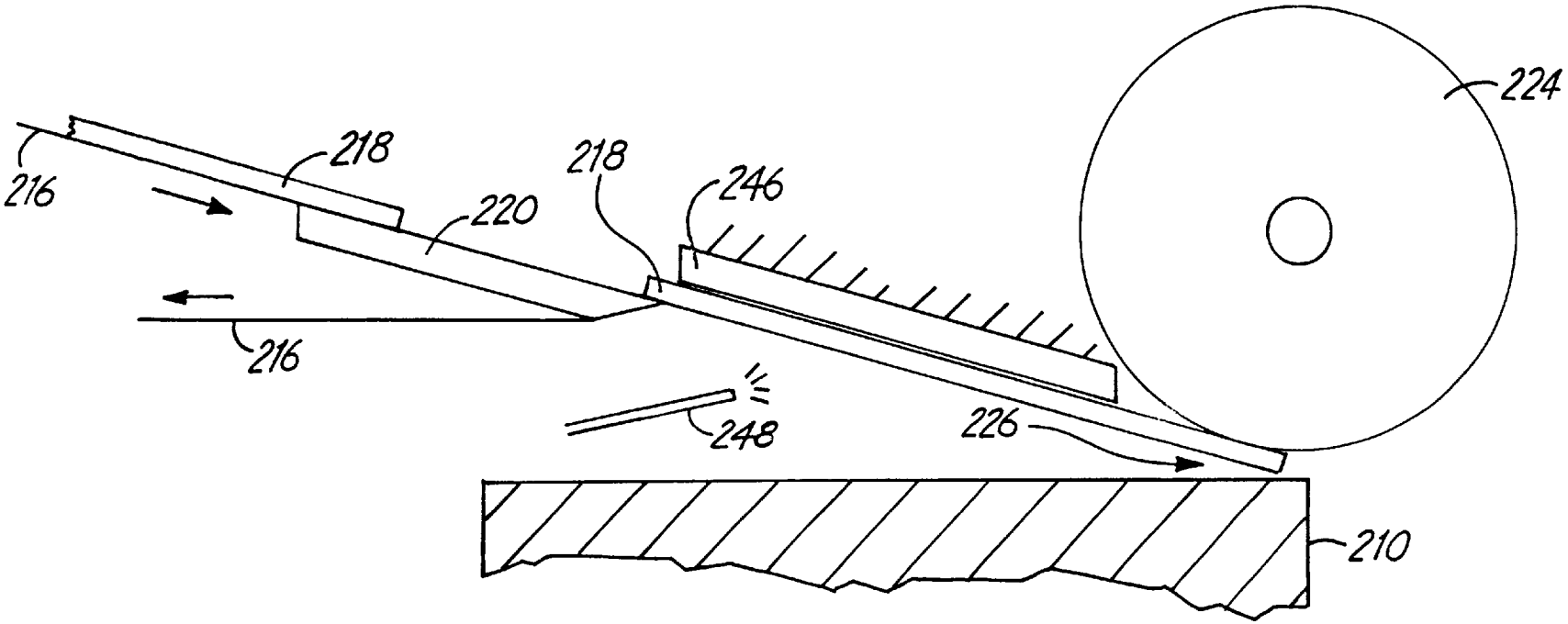
FIG. 6 is a side planar view of a label support mechanism.

Referring to FIG. 6, a label support mechanism 246 is shown. As explained above, just prior to, and during its initial entry into the nip point 226, label 218 will have (at most) minimal contact with supply web 216. As such, label 218 is almost (or entirely, in some embodiments) free floating. If the label 218 is sufficiently rigid, there is no problem in directing it into the nip point 226. Oftentimes, relatively thin flexible labels 218 may be employed. As such, when they are in an unsupported position they may bend, thus causing uneven entry into the nip point 226, which could lead to jamming. To avoid such problems, label support mechanism 246 is utilized. In its simplest form, label support mechanism 246 is one or more rods extending above the path of travel of the label 218, from the peel tip 220 to a point proximate the nip point 226. In this manner, the upper surface of label 218 will follow the rod into the nip point 226. In addition, to prevent the label 218 from bending downwards, an optional air jet 248 could be positioned so as to direct a steam of air against the underside of the label 218, thus forcing it to ride along the rod or rods used.

Alternatively, a plate could be used instead of the rods, with or without the air jet 248, achieving the same effect. Instead of using the air jet 248, a vacuum could be generated which pulls label 218 towards the plate through perforations in the plate. Once again, this serves to keep the label 218 aligned with the support mechanism 246 as it progresses towards the nip point 226. When using either the plate or rods to form the support mechanism 246, the plate or rods could be extended into the roller 224. That is, grooves could be cut into the roller to allow a portion of the rod(s) or toothed sections of the plate to extend past the outer circumference of the roller 224. In this manner, there would be no unsupported gap that any portion of the label 218 would have to travel to reach the nip point 226. Though rods and plates have been discussed, any guiding member which directs the label 218 could be utilized as label support mechanism 246.

Although the present invention has been described with reference to preferred embodiments, workers skilled in the art will recognize that changes may be made in form and detail without departing from the spirit and scope of the invention.

What is claimed is:

1. A method for applying a label on a supply web to a product conveyed by a conveyance mechanism, comprising:

conveying said product past a first sensor;

conveying said label past a second sensor;

determining a first distance, said first distance being the distance of said product to a nip point, based upon an output of said first sensor;

determining a second distance, said second distance being the distance of said label to said nip point, based upon an output of said second sensor;

calculating an electronic gear ratio by dividing said second distance by said first distance;

monitoring the instantaneous position of said supply web with a closed loop control system;

monitoring the instantaneous position of said conveyance mechanism with a positional encoder;

continuously coupling the position of said supply web to the position of said conveyance mechanism based on said electronic gear ratio; and applying said label to said product at said nip point.

2. A method for applying a label to an item conveyed by a conveyance mechanism, comprising:

determining a first distance, said first distance being the distance of an item to a nip point;

determining a second distance, said second distance being the distance of a label to said nip point;

calculating an electronic gear ratio by dividing said second distance by said first distance;

continuously coupling the position of said label with respect to the position of said item by continuously applying said electronic gear ratio to said position of said item to adjust said position of said label;

monitoring the instantaneous position of said item by monitoring the instantaneous position of said conveyance mechanism with a positional encoder;

monitoring the instantaneous position of said label by monitoring the instantaneous position of a supply web on which said label is attached;

conveying said item continuously past said nip point;

causing said supply web bearing said label to move over a peel tip to produce a peeled label;

directing said label into said nip point created with said item; and applying said label to said item.

3. The method of claim 2, further comprising supporting said peeled label while it is directed from said peel tip to said nip point.

4. The method of claim 3, further comprising:

drawing said label toward said support with vacuum forces from the time said label leaves said peel tip to the time said label arrives at said nip point.

5. A method for controlling the movement of a label of a label placement machine comprising:

determining a first distance required for an item to be labeled to travel to a nip point;

determining a second distance required for said label to travel to said nip point;

calculating an effective gear ratio using said first distance and said second distance;

monitoring the instantaneous position of said label with a closed loop control system;

monitoring the instantaneous position of said item with a positional encoder; and continuously coupling the movement of said label with respect to the movement of said item by continuously coupling the position of said label to the position of said item by continuously applying said effective gear ratio to said position of said item to adjust said position of said label such that said label and said item arrive at said nip point substantially simultaneously.

6. The method of claim 5 wherein said label and said item arrive at said nip point at substantially different speeds.

7. A method for placing a label onto an item using a label placement machine comprising:

sensing the position of said item;

sensing the position of said label;

determining a first distance required for said item to travel to a nip point;

determining a second distance required for said label to travel to said nip point;

calculating an electronic gear ratio by dividing said first distance and said second distance;

controlling the instantaneous position of said label by controlling the web on which said label is attached with a closed loop control system;

controlling the instantaneous position of said item by monitoring the position of a conveyor with a positional encoder;

continuously coupling the position of said label with respect to the position of said item by continuously applying said electronic gear ratio to said position of said item to adjust said position of said label such that said label and said item arrive at said nip point substantially simultaneously;

advancing said item to said nip point; and placing said label onto said item at said nip point.

8. The method of claim 7 further comprising:

wherein said label and said item arrive at said nip point at substantially different speeds.

* * * * *